US009076425B2

(12) United States Patent
Yoo

(10) Patent No.: US 9,076,425 B2
(45) Date of Patent: Jul. 7, 2015

(54) APPARATUS AND METHOD FOR REDUCING DIGITAL NOISE OF AUDIO SIGNAL

(71) Applicant: RADSONE Inc., Seongnam-si, Gyeonggi-do (KR)

(72) Inventor: Chul Jae Yoo, Seongnam-si (KR)

(73) Assignee: RADSONE INC., Seongnam-si, Gyeonggi-do (KR)

( * ) Notice: Subject to any disclaimer, the term of this patent is extended or adjusted under 35 U.S.C. 154(b) by 247 days.

(21) Appl. No.: 13/768,342

(22) Filed: Feb. 15, 2013

(65) Prior Publication Data

US 2013/0216059 A1 Aug. 22, 2013

(30) Foreign Application Priority Data

Feb. 16, 2012 (KR) ..... 10-2012-0015745

(51) Int. Cl.
*G10K 11/00* (2006.01)
*G10L 21/0364* (2013.01)

(52) U.S. Cl.
CPC ..... *G10K 11/002* (2013.01); *G10L 21/0364* (2013.01)

(58) Field of Classification Search
None
See application file for complete search history.

(56) References Cited

U.S. PATENT DOCUMENTS

| | | | | |
|---|---|---|---|---|
| 6,091,824 | A * | 7/2000 | Lin et al. | 381/63 |
| 6,665,409 | B1 * | 12/2003 | Rao | 381/63 |
| 2002/0067836 | A1 * | 6/2002 | Paranjpe | 381/63 |
| 2003/0169887 | A1 * | 9/2003 | Fujita et al. | 381/63 |
| 2006/0045283 | A1 * | 3/2006 | Lin et al. | 381/63 |
| 2008/0137875 | A1 * | 6/2008 | Zong et al. | 381/63 |

* cited by examiner

*Primary Examiner* — Brenda Bernardi
(74) *Attorney, Agent, or Firm* — Sherr & Jiang, PLLC

(57) ABSTRACT

Provided are an apparatus and method for reducing digital noise. The digital noise reducing apparatus includes: a clarified signal generator configured to generate a clarity improvement pattern for increasing an energy ratio of an early reflection region with respect to all reverberations for a received audio source signal, to convolve the clarity improvement pattern with the audio source signal, and to output an audio source signal convolved the audio source signal with the clarity improvement pattern; an early reflection generator configured to output an early reflection signal convolved the audio source signal with an early reflection pattern; a late reverberation generator configured to receive the audio source signal, and to generate a late reverberation signal for attenuating digital noise of the audio source signal; and a noise attenuator configured to generate an audio signal added the early reflection signal and the late reverberation signal to the audio source signal.

22 Claims, 5 Drawing Sheets

APPARATUS AND METHOD FOR REDUCING DIGITAL NOISE OF AUDIO SIGNAL

CROSS-REFERENCE TO RELATED APPLICATION

This application claims the benefit under 35 U.S.C. §119 (a) of Korean Patent Application No. 2012-0015745, filed on Feb. 16, 2012, in the Korean Intellectual Property Office, the entire disclosure of which is incorporated herein by reference for all purposes.

BACKGROUND

1. Field

The following description relates to an apparatus and method for reducing digital noise generated upon Analog-to-Digital (AD) conversion or lossy coding, using reverberation.

2. Discussion of Related Art

Since the 1990's, digital audio formats such as MP3 have been popularized. Digital audio formats such as MP3 have an advantage of allowing people to listen to the music with a small capacity since they are efficiently compressed, however, the digital audio formats have a disadvantage that they have quantization noise since they are digital signals, and also digital noise is added when audio signals are compressed.

Quantization noise (error) is generated when an analog signal is converted to a digital signal (Analog-to-Digital (AD) conversion). A representative digital conversion method is pulse code modulation (PCM). PCM performs conversion by a three-step process of sampling, quantization, and encoding as follows. In the sampling, successive analog signals are sampled at regular time intervals to generate pulse amplitude modulation (PAM) signals. In the quantization, the sampled signals are digitized. For example, quantization means representing a sampled value as the nearest value among values of predetermined levels divided in advance. During quantization, there is a difference between the analog signal value and the digitized signal value, which is called a quantization error. A finally quantized value is subject to binary encoded to thereby be converted into a digital signal.

Also, since a signal such as an MP3 signal, subject to lossy compression, cannot be decoded to its exact original signal, noise is generated upon lossy encoding and decoding. In the case of lossy encoding, generally, more digital noise is generated in high-frequency region than in low-frequency region.

As such, a digital audio source may include digital noise due to digital conversion or lossy encoding. The digital noise has random characteristics. In the case of lossy encoding, a random characteristic to which a weight is reflected according to a weight for each frequency band that is applied upon encoding, may appear. Digital noise which does not exist in natural analog audio sources deteriorates the quality of digital audio sources, and increases listening fatigue. That is, digital noise causes unpleasant noise when a digital signal is reproduced, and as such noise is greater, a listener suffers from listening fatigue when he or she listens to digital music (for example, MP3 music). Accordingly, in order to reduce listening fatigue, a method capable of reducing digital noise is needed.

SUMMARY

In one general aspect, there is provided an apparatus of reducing digital noise of an audio signal, including: a clarified signal generator configured to generate a clarity improvement pattern for increasing an energy ratio of an early reflection region with respect to all reverberations for a received audio source signal, to convolve the clarity improvement pattern with the audio source signal, and to output the result of the convolution as an audio source signal to which the clarity improvement pattern has been applied; an early reflection generator configured to convolve the audio source signal convolved with the clarity improvement pattern with an early reflection pattern, and to output the result of the convolution as an early reflection signal to which the clarity improvement pattern has been applied; a late reverberation generator configured to receive the audio source signal, and to generate a late reverberation signal for attenuating digital noise of the audio source signal; and a noise attenuator configured to add the early reflection signal and the late reverberation signal to the audio source signal, and to output the result of the addition as an audio source signal from which digital noise has been attenuated.

In one general aspect, there is provided an apparatus for reducing digital noise of an audio signal, including: a clarified signal generator configured to generate a clarity improvement pattern for increasing an energy ratio of an early reflection region with respect to all reverberations for a received audio source signal, to convolve the clarity improvement pattern with the audio source signal, and to output the result of the convolution as an audio source signal to which the clarity improvement pattern has been applied; an early reflection generator configured to convolve the audio source signal convolved with the clarity improvement pattern with an early reflection pattern, and to output the result of the convolution as an early reflection signal to which the clarity improvement pattern has been applied; a late reverberation generator configured to receive the audio source signal, and to generate a late reverberation signal for attenuating digital noise of the audio source signal; and a noise attenuator configured to add the early reflection signal and the late reverberation signal to the audio source signal, and to output the result of the addition as an audio source signal from which digital noise has been attenuated.

In another general aspect, there is provided an apparatus of for reducing digital noise of an audio signal, including: a clarified signal generator configured to generate a clarity improvement pattern for increasing an energy ratio of an early reflection region with respect to all reverberations for a received audio source signal, to convolve the clarity improvement pattern with the audio source signal, and to output the result of the convolution as an audio source signal to which the clarity improvement pattern has been applied; an early reflection generator configured to convolve the audio source signal convolved with the clarity improvement pattern with an early reflection pattern, and to output the result of the convolution as an early reflection signal to which the clarity improvement pattern has been applied; a late reverberation generator configured to receive the audio source signal convolved with the clarity improvement pattern, and to generate a late reverberation signal for attenuating digital noise of the audio source signal; and a noise attenuator configured to add the early reflection signal and the late reverberation signal to the audio source signal, and to output the result of the addition as an audio source signal from which digital noise has been attenuated.

Other features and aspects may be apparent from the following detailed description, the drawings, and the claims.

Figure 1:
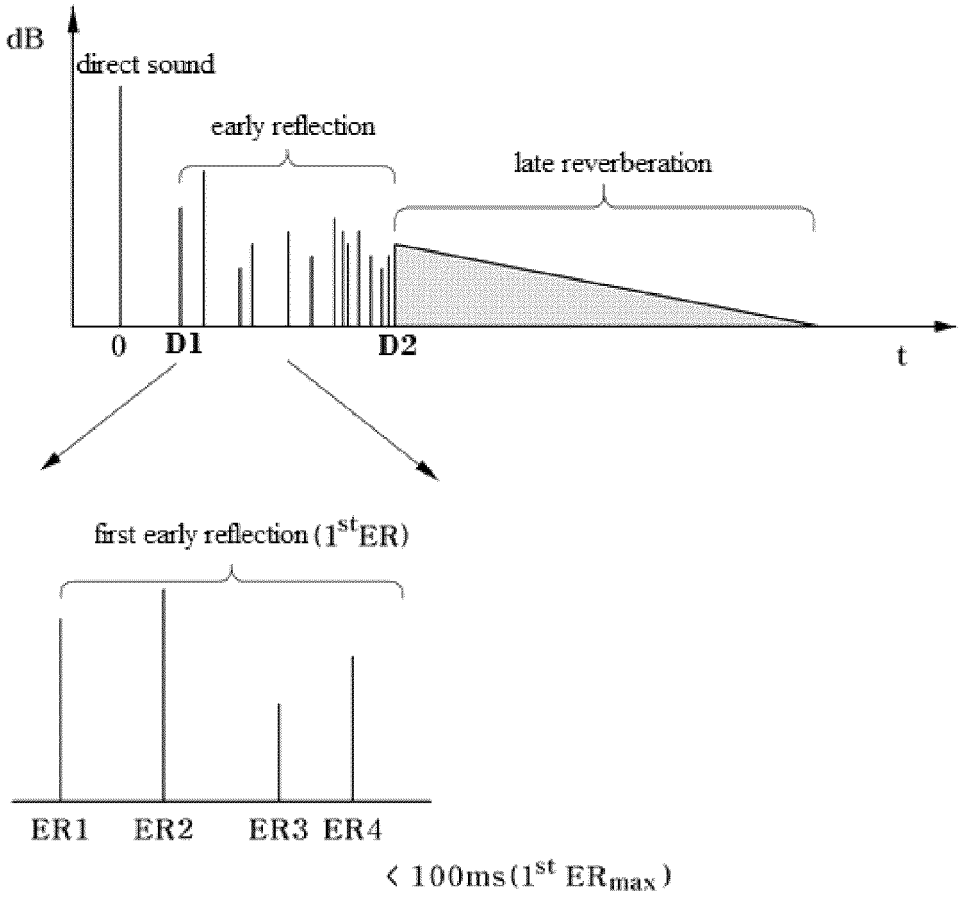
FIG. 1 illustrates an example of the impulse response in time domain according to the reverberation effect of a sound.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

Meanwhile, terminology used herein will be understood as follows. Although the terms "first," "second," etc. may be used herein to describe various elements, these elements should not be limited by these terms. These terms are only used to distinguish one element from another. For example, a first element could be termed a second element, and, similarly, a second element could be termed a first element.

As used herein, the singular forms are intended to include the plural forms as well, unless the context indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof. It should also be noted that in some alternative implementations, the processes noted in the blocks may occur out of the order noted in the flowcharts, unless the context clearly indicates a specific order. In other words, respective processes may be executed in a specified order, executed substantially concurrently, or executed in the reverse order.

Unless otherwise defined, terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 illustrates an example of an impulse response in time domain according to the reverberation effect of a sound. Generally, when an audio source generates a sound in a sound field, the sound generated from the audio source is transferred to a listener through various paths. The sound transferred to the listener includes a direct sound directly transferred from the sound source to the listener, an early reflection generated when the sound generated from the sound source is reflected against individual walls or reflection surfaces of the sound field, and a later reflection generated when the components gradually attenuate in the air and disappear. Direct sound influences the distance and direction of the audio source, and early reflection and later reflection influence the sense of space of the sound field and the sense of locality of sound. Direct sound and early reflection have directivity, whereas later reflection has no directivity. Early reflection is a sound made when direct sound is reflected against one or more reflection surfaces in several dozens of or several hundreds of microseconds after the direct sound has arrived. Early reflection offers the listener a sound stronger or richer than its original sound since the listener can feel the early reflection as a direct sound due to its high speed. Later reflection is a sound made when direct sound is reflected against peripheral surfaces several times in several hundreds of microseconds or seconds after the direct sound has arrived. Natural attenuation characteristics of a sound have been reflected to the later reflection. Generally, later reflection has a magnitude below about 60 dB of the audio source signal. FIG. 1 shows an impulse response in time domain between an input signal and an output signal when the input signal is a sound generated from a sound source, and the output signal is a sound received at a destination. In FIG. 1, the horizontal axis corresponds to time, and the vertical axis corresponds to the magnitude of a response.

Referring to FIG. 1, the impulse response is represented as a sum of different delay signals having different attenuation levels with respect to the input signal, and the impulse response is a combination of signals for forming an output signal having the reverberation effect. As shown in FIG. 1, reverberation is divided into an early reflection and a late reverberation, and the early reflection may be divided into first early reflection (first ER) and a remnant early reflection. The first early reflection is an early reflection sound reflected from a reflection surface one time. For example, if a listening space is a hexahedron, the first early reflection is a signal received at a destination after being reflected from a reflection surface, such as a wall, a ceiling, and a bottom (floor), one time. There may be maximally 6 first early reflections. For example, if an acoustic absorbent is applied on the bottom (floor) and back side among the six sides to block reflections, four early reflections ER1, ER2, ER3, and ER4 as shown in FIG. 1, are generated.

Figure 2:
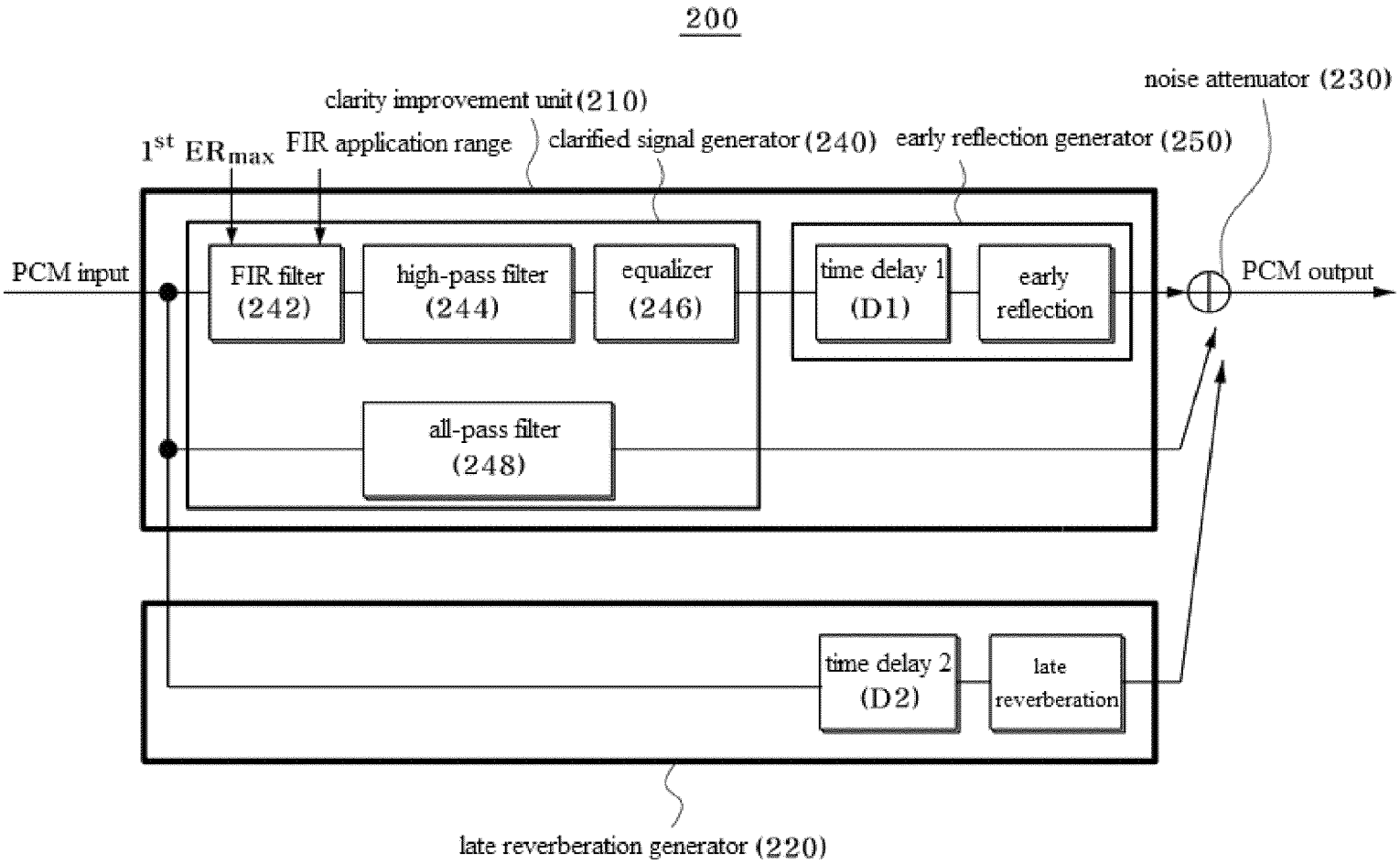
FIG. 2 illustrates an example of a block diagram of a digital noise reducing apparatus.

FIG. 2 illustrates an example of a block diagram of a digital noise reducing apparatus 200 according to an embodiment of the present invention. The digital noise reducing apparatus 200 attenuates digital noise included in a digital audio source, and outputs the resultant sound. In the present disclosure, since digital noise is attenuated using reverberation effects naturally occurring when a sound is propagated in a space, more natural audio signals than in conventional techniques can be output Referring to FIG. 2, the digital noise reducing apparatus 200 includes a clarity improvement unit 210, a late reverberation generator 220, and a noise attenuator 230 in order to output an audio source signal from which digital noise has been reduced without deteriorating the clarity of the audio source signal. The audio source signal is raw data created from a digital sound source. For example, the audio source signal may be PCM raw data. For example, PCM raw data may be created by removing header information or a flag from an audio source. As another example, in the case of an audio source such as I2S, PCM raw data may be created in synchronization with the audio source. The above examples correspond to the case where an audio source is a decompressed bit stream, and if an audio source is a compressed bit stream, PCM raw data may be created after decoding.

Generally, if reverberation is added to an audio source, deviation of the sense of space becomes significant according to the kind of audio source. For example, in the case of an audio source to which little or less reverberation is added and then recorded, an echo becomes significant when an existing reverberation technique is applied to the audio source. In order to provide a sense of space, unlike the conventional technique of adding reverberation to an audio source according to a user's selection, the present disclosure applies reverberation to all audio sources to remove digital noise from the audio sources. Accordingly, (the) echoing phenomenon, that is, the problem of clarity deterioration has to be overcome. Accordingly, the present disclosure proposes a technique of adding reverberation without deteriorating clarity.

The clarity improvement unit 210 creates a clarity improvement pattern, and generates an early reflection signal to which the clarity improvement pattern has been applied, from an input audio signal. The clarity improvement pattern is used to increase an energy ratio of an early reflection region with respect to an entire reverberation region for an audio source signal, thereby improving the clarity of the audio source signal. The clarity improvement pattern may be a pattern that causes an input signal to be output in a shape attenuating according to (a) time. According to an example, the clarity improvement pattern may be a pattern whose envelope is exponentially (linearly in DB scale) reduced in the time domain.

The clarity improvement unit 210 includes a clarified signal generator 240 and an early reflection generator 250. The clarified signal generator 240 convolves an input signal with a clarity improvement pattern, and thus outputs a signal to which the clarity improvement pattern has been applied. The output signal is used to improve the clarity of an audio source signal. According to an embodiment, if an audio source signal is input to the clarified signal generator 240, the signal is convolved with the clarity improvement pattern, and then output. The early reflection generator 250 convolves the input signal with an early reflection pattern, and thus outputs a signal to which the early reflection pattern has been applied. For example, if an audio source signal convolved with the clarity improvement pattern, output from the clarified signal generator 240, is input to the early reflection generator 250, the early reflection generator 250 outputs an early reflection signal to which the clarity improvement pattern has been applied. The embodiment shown in FIG. 2 corresponds to the case where an audio source signal (for example, a PCM signal) is input to the clarified signal generator 240, and then an early reflection signal to which a clarity improvement pattern has been applied, is output from the early reflection generator 250, however, the arrangement order of the clarified signal generator 240 and the early reflection generator 250 may be reversed. That is, the early reflection generator 250 may receive an audio source signal and output an early reflection signal, and then, the clarified signal generator 240 may receive the early reflection signal from the early reflection generator 250, and output an early reflection signal to which a clarity improvement pattern has been applied.

Figure 5:
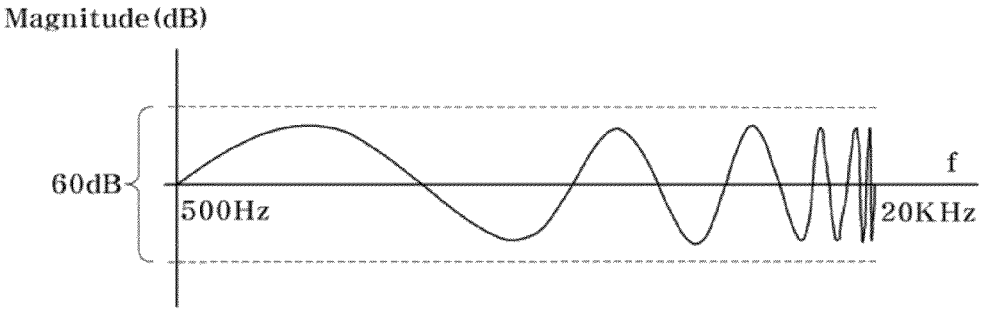
FIG. 5 is a graph illustrating an example of the frequency response of a clarity improvement pattern.

Meanwhile, according to an embodiment, the clarified signal generator 240 includes a finite impulse response (FIR) filter 242 and a high-pass filter 244 that are connected in series to each other in order to generate a clarity improvement pattern. The FIR filter 242 is designed to have an impulse response similar to an impulse response measured at a location, such as an audiovisual room, a concert hall, and an oratorium. For example, a frequency response at an audible frequency of the FIR filter 242 may have a plurality of peaks and valleys in the range of 60 dB, as shown in FIG. 5. The FIR filter 242 is also designed such that the length of the clarity improvement pattern does not exceed 20×first $ER_{max}$. The first $ER_{max}$ means the latest one of times at which reflections existing in the first early reflection part of an early reflection region arrive. Generally, since the first $ER_{max}$ has a value below 100 ms, the length of the FIR filter 242 is designed to 2 seconds or less. The first $ER_{max}$ is a control factor of the FIR filter 242, and may be used to design the FIR filter 242. Also, the FIR filter 242 may receive an application range as a control factor. The application range is a control factor for determining whether the clarity improvement pattern of the FIR filter 242 has to be applied to first early reflection part, to the entire early reflection region, or to the entire reverberation region. For example, if the application range of the FIR filter 242 is set to first early reflection part, the early reflection generator 250 may convolve an audio source signal with which the clarity improvement pattern has been convolved, with a reflection pattern corresponding to the first early reflection part of an early reflection pattern, and thus output an early reflection signal to which the clarity improvement pattern has been applied. If the FIR filter 242 is applied only to the first early reflection part, clarity improvement performance increases.

The high-pass filter 244 is used to cut off low-frequency energy. A low-frequency signal amplifies the echo of a sound, which leads to deterioration of sound quality. The cut-off frequency of the high-pass filter 244 may be decided to a value between 100 Hz and 1000 Hz. FIG. 5 shows an example in which the cut-off frequency of the high-pass filter 244 is 500 Hz. If the cut-off frequency of the high-pass filter 244 is 500 Hz, the clarity improvement pattern may have a frequency response characteristic in which a plurality of peaks and valleys exist in the range of 60 dB between 500 Hz and 20 kHz.

According to an embodiment, the clarified signal generator 240 may further include an equalizer 246 or an all-pass filter 248. The equalizer 246 is connected in series to the FIR filter 242 or the high-pass filter 244 to correct the frequency characteristics of a signal convolved with the clarity improvement pattern, and output the corrected signal. The all-pass filter 248 is used to correct distortion of an audio source at below the cut-off frequency, caused by the high-pass filter 244. For example, the all-pass filter 248 is designed to have substantially the same phase characteristic as that at below the cut-off frequency of the high-pass filter 244. The all-pass filter 248 may generate an audio source signal with a corrected phase characteristic, from a received audio source signal, and provide the audio source signal to the noise attenuator 230.

The early reflection generator 250 may generate an early reflection signal according to various reverberation generation methods. For example, the early reflection generator 250 may be a comb filter, a parallel comb filter, an all-pass filter, a FIR filter, a feedback delay network, or their combination. For example, if the early reflection generator 250 is a parallel comb filter, each comb filter may form a feedback structure including a multiplier and a delay.

The late reverberation generator 220 generates a late reverberation signal for attenuating digital noise of an audio source signal input to the digital noise reducing apparatus 200. (The) Digital noise has the characteristics of a random signal, and the late reverberation signal also has the characteristics of a random signal having no directivity. Also, since the late reverberation signal (for example, below 60 dB) has a magnitude greater than general digital noise (for example, the dynamic range of 16-bit quantization is 96 dB), the late reverberation signal has an effect of masking digital noise to reduce noise. Meanwhile, the high-frequency band of a late reverberation signal is attenuated more quickly than its low-frequency band. The (This/Such) characteristic may be effectively used to reduce noise more generated in a high-frequency band upon lossy compression. The late reverberation generator 220, like the early reflection generator 250, may generate a late reverberation using a comb filter, a parallel comb filter, an all-pass filter, a FIR filter, a feedback delay network, etc.

The noise attenuator 230 adds the early reflection signal to which the clarity improvement pattern has been applied, and the late reverberation signal, to the audio source signal input to the digital noise reducing apparatus 200, thereby outputting an audio source signal from which digital noise has been attenuated. According to an embodiment, if the clarified signal generator 240 includes the all-pass filter 248, the noise attenuator 230 adds the early reflection signal to which the clarity improvement pattern has been applied, and the late reverberation signal, to the audio source signal whose phase characteristic has been corrected, provided from the all-pass filter 248, thereby outputting an audio source signal from which digital noise has been attenuated.

Figure 3:
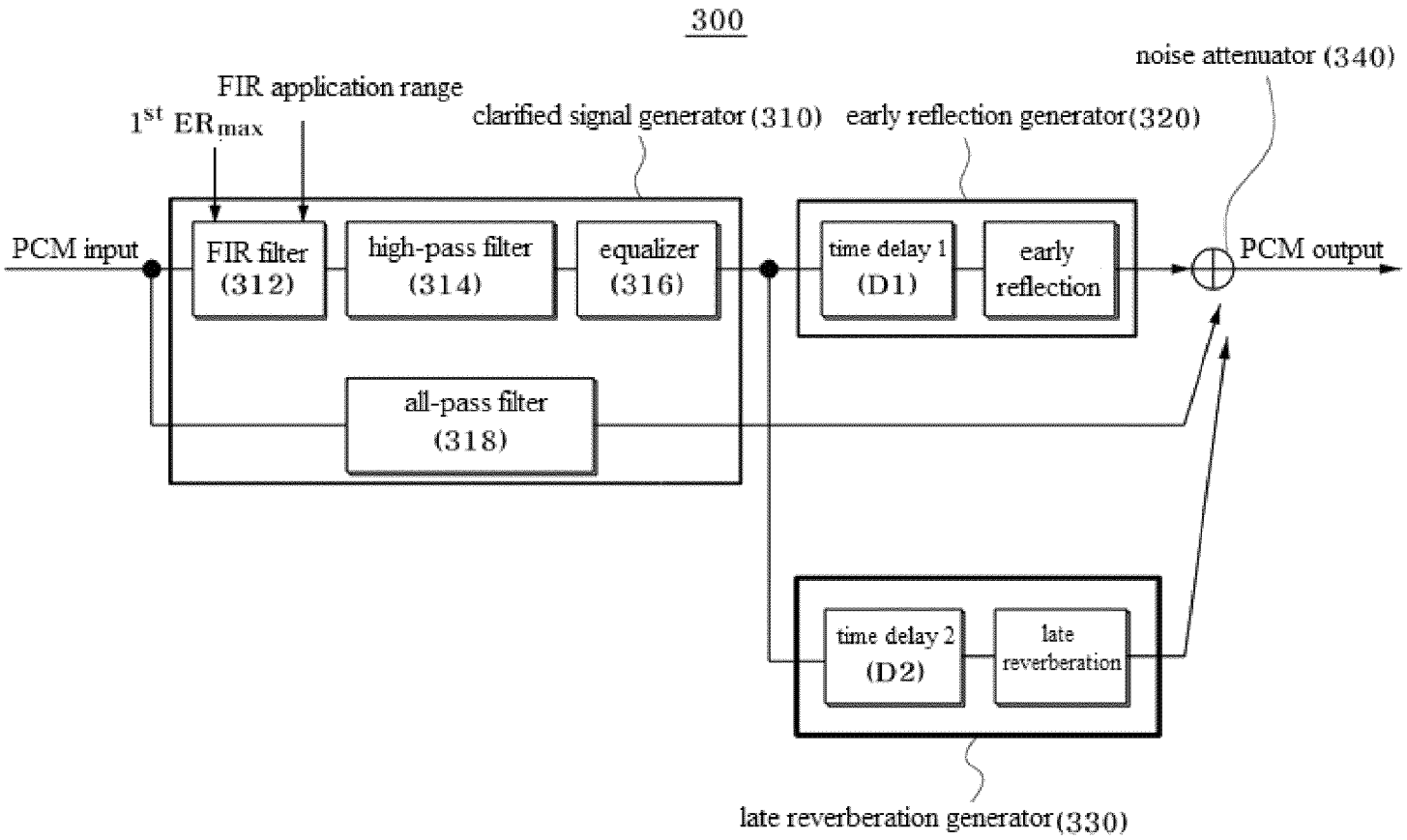
FIG. 3 illustrates an example of a block diagram of a digital noise reducing apparatus.

FIG. 3 illustrates an example of a block diagram of a digital noise reducing apparatus 300 according to another embodiment of the present invention. The digital noise reducing apparatus 300 of FIG. 3 is different from the digital noise reducing apparatus 200 of FIG. 2 in that a clarity improvement pattern is applied to both an early reflection signal and a late reverberation signal. The digital noise reducing apparatus 300 of FIG. 3 applies a clarity improvement pattern to a late reverberation signal while reducing digital noise using the reverberation effect, thereby outputting a more natural audio signal.

Referring to FIG. 3, the digital noise reducing apparatus 300 includes a clarified signal generator 310, an early reflection generator 320, a late reverberation generator 330, and a noise attenuator 340 in order to output a natural audio source signal from which digital noise has been attenuated without deteriorating the clarity of a received audio source signal. The audio source signal means raw data created by a digital audio source, and for example, the audio source signal may be PCM raw data.

The clarified signal generator 310 generates a clarity improvement pattern for increasing an energy ratio of an early reflection region with respect to reverberations for a received audio source signal, and convolves the clarity improvement pattern with the audio source signal to thus output an audio signal to which the clarity improvement pattern has been applied. The early reflection generator 320 convolves the audio source signal to which the clarity improvement pattern has been applied, with an early reflection pattern, to thus output an early reflection signal to which the clarity improvement pattern has been applied. The late reverberation generator 330 receives the audio source signal to which the clarity improvement pattern has been applied, and thus generates a late reverberation signal for attenuating digital noise of the audio source signal input to the digital noise reducing apparatus 300. The noise attenuator 340 adds the early reflection signal and the late reverberation signal to the audio source signal, thereby outputting an audio source signal from which digital noise has been attenuated.

The digital noise reducing apparatus 300 of FIG. 3 is substantially the same as the digital noise reducing apparatus 200 of FIG. 2, except that the late reverberation generator 330 receives an audio source signal to which a clarity improvement pattern has been applied, from the clarified signal generator 310, and generates a late reverberation signal from the audio source signal to which the clarity improvement pattern has been applied.

Figure 4:
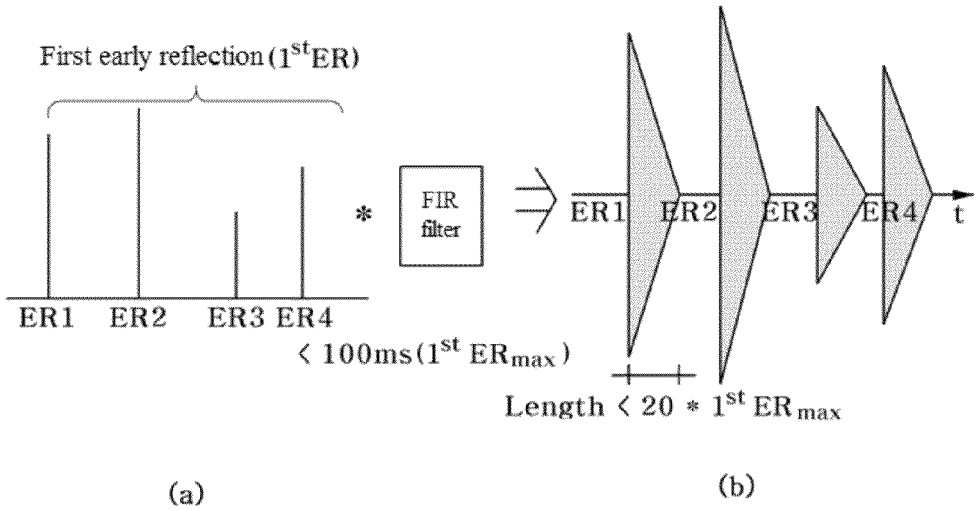
FIG. 4 illustrates an example of a view for explaining an early reflection to which a clarity improvement pattern has been applied.

FIG. 4 illustrates an example of a view for explaining an early reflection signal to which a clarity improvement pattern has been applied. (a) of FIG. 4 shows an example of first early reflection. The first early reflection means the first signals to arrive among early reflections. For example, (a) of FIG. 4 corresponds to the case where when a listening space is a hexahedron, four first early reflections ER1, ER2, ER3, and ER4 arrive by applying an acoustic absorbent on the bottom (floor) and back side to block reflections.

(b) of FIG. 4 shows the envelope of a signal whose first early reflection part is subject to a FIR filter. For example, an audio source signal is convolved by the FIR filter 242 and the early reflection generator 250 (see FIG. 2), sequentially, (the order of convolution may change) to be converted to an audio signal with an envelope as shown in (b) of FIG. 4. That is, if the first early reflections as shown in (a) of FIG. 4 pass through a FIR filter, a signal with an envelope as shown in (b) of FIG. 4, to which a clarity improvement pattern has been applied, is generated. At this time, the clarity improvement pattern has a shape whose envelope is exponentially (linearly in dB scale) reduced in the time domain. As shown in (b) of FIG. 4, the clarity improvement pattern is applied to each early reflection, so that each early reflection is linearly (in dB scale) attenuated.

FIG. 5 is a graph illustrating an example of the frequency characteristics of a clarity improvement pattern. As shown in FIG. 5, the clarity improvement pattern has a plurality of peaks and valleys in the range of 60 dB. According to an embodiment, if the cut-off frequency of the high-pass filters 244 and 314 (see FIGS. 2 and 3) included in the clarified signal generators 240 and 310 (see FIGS. 2 and 3) is 500 Hz, the clarity improvement pattern may have a frequency response characteristic in which a plurality of peaks and valleys exist in the range of 60 dB between 500 Hz and 20 kHz.

The digital noise reducing apparatuses 200 and 300 shown in FIGS. 2 and 3 may be applied to various electronics, such as an MP3 player, a mobile phone, a sound system for a vehicle, a TV, a home theater, a multimedia computer, a CD player, a DVD player, a digital radio, etc.

The above-described embodiments may be applied to compressed audio sources, such as MP3, AAC, Dolby Digital, DTS, etc., and to decompressed audio sources, such as CD, DVD, etc. Also, if the sound source of an audio device is a stereo signal, the different digital noise reducing apparatuses 200 and 300 may be applied to the respective left and right signals.

Figure 6:
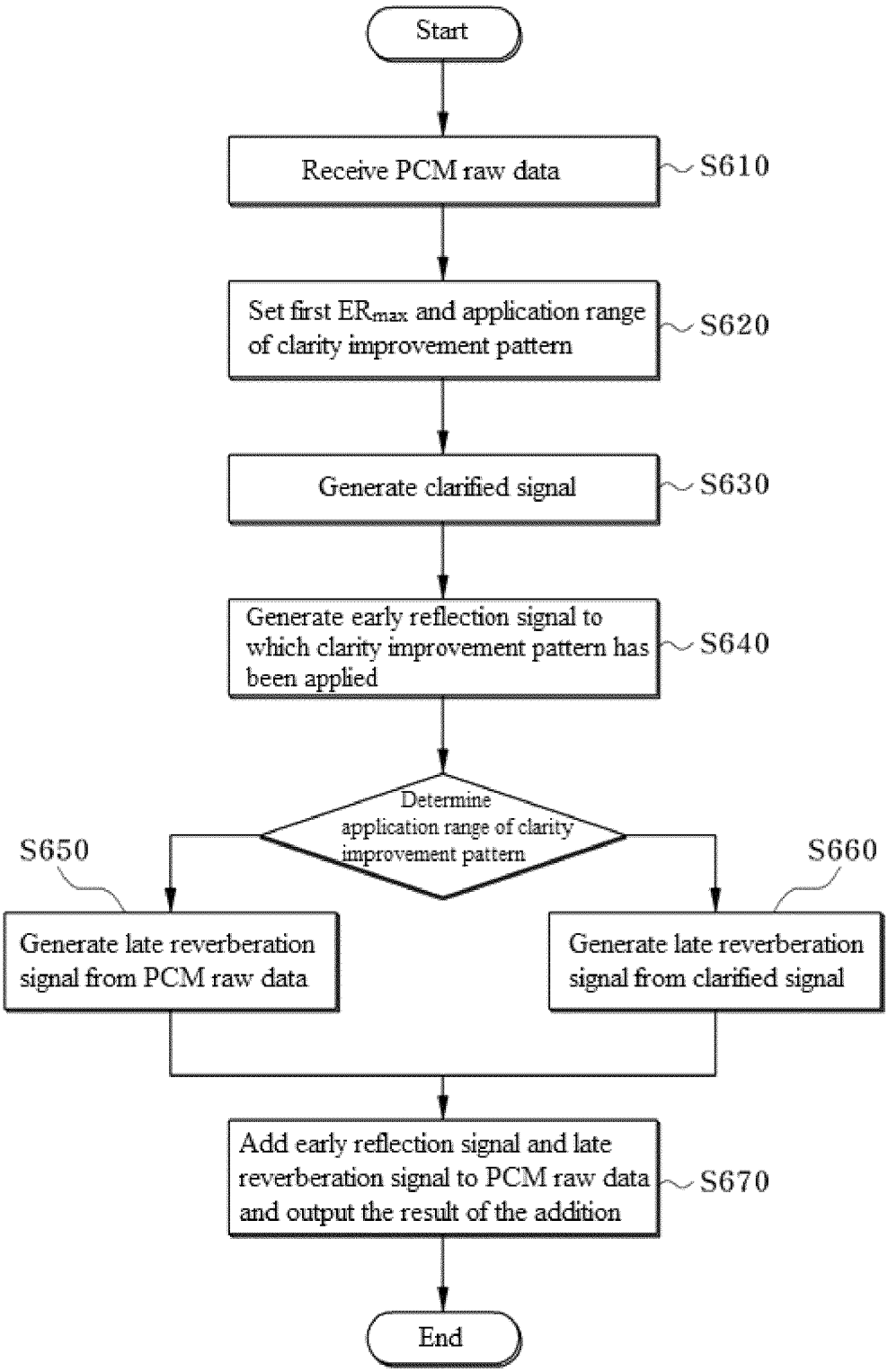
FIG. 6 is a flowchart illustrating an example of a digital noise reducing method.

FIG. 6 is a flowchart illustrating an example of a digital noise reducing method according to an embodiment of the present invention. Since the embodiment of FIG. 6 includes a digital noise reducing method in which the digital noise reducing apparatuses 200 and 300 of FIGS. 2 and 3 are implemented in time series, the above description with reference to FIGS. 2 and 3 will be applied to the following description with reference to FIG. 6 in a similar manner. Hereinafter, the digital noise reducing method will be described in detail with reference to FIG. 6.

In operation S610, a digital noise reducing apparatus receives an audio source signal. For example, the digital noise reducing apparatus may receive PCM raw data as an audio source signal. In operation S620, control factors, such as first $ER_{max}$ and an application range, are set in the digital noise reducing apparatus. For example, the control factors may be set in a FIR filter of the digital noise reducing apparatus.

In operation S630, the digital noise reducing apparatus generates a clarity improvement pattern for increasing an energy ratio of an early reflection region with respect to reverberations for the received audio source signal, and convolves the clarity improvement pattern with the audio source signal to thus output an audio source signal to which the clarity improvement pattern has been applied. At this time, the clarity improvement pattern has a shape whose envelope is exponentially reduced in the time domain. Also, the frequency response between 500 Hz and 20 kHz of the clarity improvement pattern may have a plurality of peaks and valleys in the range of 60 dB. According to an embodiment, the digital noise reducing apparatus uses a FIR filter and a high-pass filter to create the clarity improvement pattern. The digital noise reducing apparatus may transfer the audio source signal to the FIR filter and the high-pass filter, sequentially, and generate an audio source signal to which the clarity improvement pattern has been applied.

In operation S640, the digital noise reducing apparatus convolves the audio source signal to which the clarity improvement pattern has been applied, with an early reflection pattern to generate an early reflection signal to which the clarity improvement pattern has been applied. According to an embodiment, if the clarity improvement pattern has been set to be applied only to first early reflection part, the digital noise reducing apparatus may convolve the audio source signal to which the clarity improvement pattern has been applied, with a reflection pattern corresponding to the first early reflection part of the early reflection pattern, and thus output an early reflection signal to which the clarity reflection pattern has been applied.

A late reverberation signal may be generated by operations S650 and S660 according to the pre-set application range of the clarity improvement pattern. First, if the clarity improvement pattern has been set to be applied only to an early reflection region, the digital noise reducing apparatus generates a late reverberation signal from the audio source signal received in operation S610 (S650). Meanwhile, if the clarity improvement pattern has been set to be applied to the entire reverberation region, the digital noise reducing apparatus generates a late reverberation signal from the audio source signal to which the clarity improvement pattern has been applied, generated in operation S630 (S660).

In operation S670, the digital noise reducing apparatus adds the early reflection signal (generated in operation S640) and the late reverberation signal (generated in operation S650 or S660) to the audio source signal received in operation S610, and outputs an audio source signal from which digital noise has been attenuated. Unlike the embodiment illustrated in FIG. 6, the digital noise reducing method may further include an operation (not shown) of generating an audio source signal having substantially the same phase characteristic as that at below the cut-off frequency of a high-pass filter. In this case, in operation S670, the digital noise reducing apparatus adds the early reflection signal (generated in operation S640) and the late reverberation signal (generated in operation S650 or S660) to an audio source signal having the phase characteristic, and outputs an audio source signal from which digital noise has been attenuated.

As described above, according to the present disclosure, by adding a random signal for attenuating digital noise existing in a digital audio signal, using a late reverberation naturally occurring in a sound field, it is possible to output a more natural sound than in conventional noise reducing techniques. Also, by applying a clarity improvement pattern with an exponentially reducing shape to a reverberation signal, it is possible to prevent clarity from deteriorating due to addition of reverberation.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. An apparatus for reducing digital noise of an audio signal, comprising:

a clarified signal generator configured to generate a clarity improvement pattern for increasing an energy ratio of an early reflection region with respect to all reverberations for a received audio source signal, to convolve the clarity improvement pattern with the audio source signal, and to output the result of the convolution as an audio source signal to which the clarity improvement pattern has been applied;

an early reflection generator configured to convolve the audio source signal convolved with the clarity improvement pattern with an early reflection pattern, and to output the result of the convolution as an early reflection signal to which the clarity improvement pattern has been applied;

a late reverberation generator configured to receive the audio source signal, and to generate a late reverberation signal for attenuating digital noise of the audio source signal; and a noise attenuator configured to add the early reflection signal and the late reverberation signal to the audio source signal, and to output the result of the addition as an audio source signal from which digital noise has been attenuated.

2. An apparatus for reducing digital noise of an audio signal, comprising:

a clarified signal generator configured to generate a clarity improvement pattern for increasing an energy ratio of an early reflection region with respect to all reverberations for a received audio source signal, to convolve the clarity improvement pattern with the audio source signal, and to output the result of the convolution as an audio source signal to which the clarity improvement pattern has been applied;

an early reflection generator configured to convolve the audio source signal convolved with the clarity improvement pattern with an early reflection pattern, and to output the result of the convolution as an early reflection signal to which the clarity improvement pattern has been applied;

a late reverberation generator configured to receive the audio source signal convolved with the clarity improvement pattern, and to generate a late reverberation signal for attenuating digital noise of the audio source signal; and a noise attenuator configured to add the early reflection signal and the late reverberation signal to the audio source signal, and to output the result of the addition as an audio source signal from which digital noise has been attenuated.

3. The apparatus of claim 2, wherein the clarified signal generator comprises a finite impulse response (FIR) filter and a high-pass filter connected in series to each other, and configured to generate the clarity improvement pattern, to convolve the audio source signal with the clarity improvement pattern, and to output the result of the convolution.

4. The apparatus of claim 3, wherein the clarified signal generator further comprises an all-pass filter configured to generate an audio source signal having substantially the same phase characteristic as a phase characteristic at below a cut-off frequency of the high-pass filter, from the audio source signal, and to provide the generated audio source signal to the noise attenuator.

5. The apparatus of claim 3, wherein the clarified signal generator further comprises an equalizer connected in series to the FIR filter or the high-pass filter, and configured to correct a frequency characteristic of the audio source signal convolved with the clarity improvement pattern, and to output the corrected audio source signal.

6. The apparatus of claim 3, wherein the clarity improvement pattern has a shape whose envelope has gradually exponential decay in time domain.

7. The apparatus of claim 3, wherein a frequency response of the clarity improvement pattern has a plurality of peaks and a plurality of valleys in the range of 60 dB between 500 Hz and 20 kHz, and the length of the clarity improvement pattern is below 20×first $ER_{max}$, wherein the first $ER_{max}$ is the latest time of times at which reflections existing in the first early reflection part of the early reflection region arrive.

8. The apparatus of claim 2, wherein the FIR filter receives first $ER_{max}$ and an application range of FIR, as control factors, wherein the first $ER_{max}$ is the latest time of times at which reflections existing in the first early reflection part of the early reflection region arrive, and if the application range of the FIR filter is set to first early reflection part, the early reflection generator convolves the audio source signal convolved with the clarity improvement pattern with a reflection pattern corresponding to the first early reflection part of the early reflection pattern, and outputs the result of the convolution as the early reflection signal to which the clarity improvement pattern has been applied.

9. The apparatus of claim 2, wherein the early reflection generator and the late reverberation generator include at least one of comb filter, parallel comb filter, all-pass filter, finite impulse response (FIR) filter, and feedback delay network.

10. The apparatus of claim 1, wherein the clarified signal generator comprises a finite impulse response (FIR) filter and a high-pass filter connected in series to each other, and configured to generate the clarity improvement pattern, to convolve the audio source signal with the clarity improvement pattern, and to output the result of the convolution.

11. The apparatus of claim 10, wherein the clarified signal generator further comprises an all-pass filter configured to generate an audio source signal having substantially the same phase characteristic as a phase characteristic at below a cut-off frequency of the high-pass filter, from the audio source signal, and to provide the generated audio source signal to the noise attenuator.

12. The apparatus of claim 10, wherein the clarified signal generator further comprises an equalizer connected in series to the FIR filter or the high-pass filter, and configured to correct a frequency characteristic of the audio source signal convolved with the clarity improvement pattern, and to output the corrected audio source signal.

13. The apparatus of claim 10, wherein the clarity improvement pattern has a shape whose envelope has gradually exponential decay in time domain.

14. The apparatus of claim 10, wherein a frequency response of the clarity improvement pattern has a plurality of peaks and a plurality of valleys in the range of 60 dB between 500 Hz and 20 kHz, and the length of the clarity improvement pattern is below 20×first $ER_{max}$, wherein the first $ER_{max}$ is the latest time of times at which reflections existing in the first early reflection part of the early reflection region arrive.

15. The apparatus of claim 10, wherein the FIR filter receives first $ER_{max}$ and an application range of FIR, as control factors, wherein the first $ER_{max}$ is the latest time of times at which reflections existing in the first early reflection part of the early reflection region arrive, and if the application range of the FIR filter is set to first early reflection part, the early reflection generator convolves the audio source signal convolved with the clarity improvement pattern with a reflection pattern corresponding to the first early reflection part of the early reflection pattern, and outputs the result of the convolution as the early reflection signal to which the clarity improvement pattern has been applied.

16. The apparatus of claim 1, wherein the early reflection generator and the late reverberation generator include at least one of comb filter, parallel comb filter, all-pass filter, finite impulse response (FIR) filter, and feedback delay network.

17. A method of reducing digital noise of an audio signal, comprising:

generating a clarity improvement pattern for increasing an energy ratio of an early reflection region with respect to all reverberations for a received audio source signal, convolving the clarity improvement pattern with the audio source signal, and outputting the result of the convolution as an audio source signal to which the clarity improvement pattern has been applied;

convolving the audio source signal convolved with the clarity improvement pattern with an early reflection pattern, and outputting the result of the convolution as an early reflection signal to which the clarity improvement pattern has been applied;

generating a late reverberation signal from the audio source signal if the clarity improvement pattern has been set to be applied to an early reflection region according to a predetermined application range of the clarity improvement pattern, and generating a late reverberation signal from the audio source signal convolved with the clarity improvement pattern if the clarity improvement pattern has been set to be applied to an entire reverberation region; and adding the early reflection signal and the late reverberation signal to the audio source signal, and outputting the result of the addition as an audio source signal from which digital noise has been attenuated.

18. The method of claim 17, wherein the outputting of the audio source signal convolved with the clarity improvement pattern comprises generating the clarity improvement pattern using a finite impulse response (FIR) filter and a high-pass filter connected in series to each other, convolving the audio source signal with the generated clarity improvement pattern, and outputting the result of the convolution.

19. The method of claim 18, further comprising generating an audio source signal having substantially the same phase characteristic as a phase characteristic at below a cut-off frequency of the high-pass filter, from the audio source signal, wherein the outputting of the audio source signal from which digital noise has been attenuated comprises adding the early reflection signal and the late reverberation signal to the audio source signal having the phase characteristic, and outputting the result of the addition as the audio source signal from which digital noise has been attenuated.

20. The method of claim 17, wherein the clarity improvement pattern has a shape whose envelope has gradually exponential decay in time domain.

21. The method of claim 17, wherein a frequency response of the clarity improvement pattern has a plurality of peaks and a plurality of valleys in the range of 60 dB between 500 Hz and 20 kHz, and the length of the clarity improvement pattern is below 20×first $ER_{max}$, wherein the first $ER_{max}$ is the latest time of times at which reflections existing in the first early reflection part of the early reflection region arrive.

22. The method of claim 17, wherein the outputting of the early reflection signal comprises convolving the audio source signal convolved with the clarity improvement pattern with a reflection pattern corresponding to the first early reflection part of the early reflection pattern if the application range has been set such that the clarity improvement pattern is applied to first early reflection part, and outputting the result of the convolution as the early reflection signal to which the clarity improvement pattern has been applied.

* * * * *